US006203957B1

(12) United States Patent
Nomura et al.

(10) Patent No.: US 6,203,957 B1
(45) **Date of Patent: *Mar. 20, 2001**

(54) SPHERICAL TONER PARTICLE

(75) Inventors: Minoru Nomura; Hitoshi Takayanagi; Kenichi Hirabayashi, all of Saitama; Takashi Ito, Tokyo; Kazuo Itoya, Saitama; Masahiro Yoshida, Tokyo, all of (JP)

(73) Assignee: Dianippon Ink and Chemicals, Inc., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/239,823

(22) Filed: Jan. 29, 1999

(51) Int. Cl.[7] ..... G03G 13/06
(52) U.S. Cl. ..... 430/110; 430/111; 430/137
(58) Field of Search ..... 430/110, 111, 430/137

(56) References Cited

U.S. PATENT DOCUMENTS

| | | | | |
|---|---|---|---|---|
| 4,987,454 | | 1/1991 | Natsuhara et al. | 355/259 |
| 4,996,126 | | 2/1991 | Anno et al. | 430/106.6 |
| 5,164,774 | | 11/1992 | Tomita et al. | 355/245 |
| 5,691,095 | * | 11/1997 | Shinzo et al. | 430/106 |
| 5,885,743 | * | 3/1999 | Takayanagi et al. | 430/110 |

FOREIGN PATENT DOCUMENTS

| | | |
|---|---|---|
| 445 986 | 11/1991 | (EP) . |
| 1-158459 | 6/1989 | (JP) . |
| 1-185653 | 7/1989 | (JP) . |
| 2-3074 | 1/1990 | (JP) . |
| 3-100660 | 4/1991 | (JP) . |
| 3-100661 | 4/1991 | (JP) . |
| 3-259161 | 11/1991 | (JP) . |
| 4-276762 | 10/1992 | (JP) . |
| 8-211655 | 8/1996 | (JP) . |
| 8-234493 | 9/1996 | (JP) . |
| 9-15902 | 1/1997 | (JP) . |
| 9-15903 | 1/1997 | (JP) . |
| 9-90671 | 4/1997 | (JP) . |
| 9-179339 | 7/1997 | (JP) . |
| 10-20539 | 1/1998 | (JP) . |
| 10-133453 | 5/1998 | (JP) . |

* cited by examiner

*Primary Examiner*—Mark Chapman
(74) *Attorney, Agent, or Firm*—Armstrong, Westerman, Hattori, McLeland & Naughton L.L.P.

(57) ABSTRACT

A spherically particulate toner characterized by a volume-average particle diameter of from 1 to 6 $\mu$m, a colorant content of not less than 9.1% by weight, particularly not less than 5% by weight when the colorant is an organic chromatic pigment, based on the total weight of the binder resin and colorant used and an average circularity (average of circularity defined by (perimeter of circle having the same area as the projected area of particle)/(perimeter of the projected image of particle)) of not less than 0.98. The spherically particulate toner according to the present invention gives an excellent image quality and can be consumed in a drastically reduced amount per sheet of printing paper. By predetermining the particle size distribution of spherical toner particles and the added amount of inorganic oxide fine particles to optimum values, the image quality can be further improved.

27 Claims, No Drawings

SPHERICAL TONER PARTICLE

FIELD OF THE INVENTION

The present invention relates to a novel toner for use in the development of an electrostatic latent image in an electrophotographic printer or copying machine. More particularly, the present invention relates to a novel toner which provides an excellent image quality and can be consumed in a drastically reduced amount per page of printing paper.

BACKGROUND OF THE INVENTION

In recent years, it has been important to further reduce the particle diameter of powder toners for electrostatic image development in order to improve image properties such as resolution. Thus, various technical developments have been made. Most of powder toners for development of electrostatic image commercially available at present have a volume-average particle diameter of from about 8 to 13 μm. Powder toners having the smallest particle diameter have a particle diameter of about 7 μm (as measured by means of Coulter Multisizer).

Images outputted from the current electrophotographic copying machines or printers have far poorer quality than lithographic print or silver salt system photograph. For the part of toner, it is effective to develop a toner having an even smaller particle diameter and an excellent triboelectricity in order to improve these image properties. Such a toner has thus been keenly desired.

The processes for the preparation of toners can be roughly divided into two groups, i.e., dry process and wet process. Examples of the dry process for the preparation of toners include pulverization process. Examples of the wet process for the preparation of toners include polymerization process, and so-called phase inversion emulsification process as disclosed in JP-A-5-66600 (The term "JP-A" as used herein means an "unexamined published Japanese patent application") It is said that the minimum allowable particle diameter of toners obtained on an industrial basis by pulverization process using the current crushing machine is about 7 μm. Of course, toners having a particle diameter as small as about 5 μm can be produced. However, the production of such a small particle diameter toner is not practical because it adds to production cost and is liable to deterioration of triboelectricity or powder fluidity accompanying the reduction of the particle diameter of toner particles.

It is said that a wet process such as polymerization process and emulsion process essentially finds no difficulty in the reduction of the particle diameter of toner particles. However, the development or production of the prior art wet process toners is mainly intended to replace crushed toners having a particle diameter of from about 7 to 13 μm. Small particle diameter toners having a volume-average particle diameter of not more than about 6 μm have been so far known only in fragments. No practical formulations have been known.

U.S. Pat. No. 5,691,095 discloses inventions of spherically particulate toner and process for the preparation thereof. However, no studies were made of the range of concentration of colorant. The values of concentration of colorant described in the examples in the above cited US patent are all lower than that of the present invention. Thus, the toner according to the above cited US patent doesn't exert the effect of the, present invention.

An object of the present invention is to provide a novel toner for use in the development of an electrostatic latent image in an electrophotographic printer or copying machine which provides an excellent image quality and can be consumed in a drastically reduced amount per page of printing paper.

SUMMARY OF THE INVENTION

The inventors made extensive studies of powder toner excellent in density, resolution and tone reproduction in printed image. As a result, it was found that a spherically particulate toner having a small particle diameter and a high pigment concentration provides an excellent image quality and can be consumed in a drastically reduced amount per gage of printing paper. It was also found that such a spherically particulate toner produced by emulsification method or polymerization method is suitable for the present invention. It was further found that such a spherically particulate toner can be preferably used as a toner for non-magnetic one-component development process and two-component development process. The present invention has thus been worked out.

The present invention provides the following inventions:

1. A spherically particulate toner comprising a colorant and a binder resin, wherein said toner has a volume-average particle diameter of from 1 to 6 μm, the content of the colorant is not less than 9.1% by weight based on the total weight of the binder resin and the colorant, and said toner has an average circularity (average of circularity defined by (perimeter of circle having the same area as the projected area of particle)/(perimeter of the projected image of particle)) of not less than 0.98.

2. The spherically particulate toner according to Clause 1, having a particle size distribution such that the ratio of 50%-volume particle diameter/50%-number particle diameter is not more than 1.25 and the square root of the ratio of 84%-volume particle diameter/16%-volume particle diameter is not more than 1.25 and comprising the colorant encapsulated in the binder resin.

3. The spherically particulate toner according to Clause 1, comprising inorganic oxide fine particles externally added to the surface thereof in an amount represented by the following general formula:

$$3.5714X^{-0.9942} \leqq Y \leqq 31.399X^{-0.9477}$$

wherein X represents a volume-average particle diameter (μm) of toner particles; and Y represents an added amount (wt-%) of the inorganic oxide fine particles based on the weight of toner particles.

4. The spherically particulate toner according to any one of Clauses 1 to 3, wherein said particulate toner is obtained by mixing an organic solvent solution comprising a colorant and a water-insoluble binder resin as essential components and an aqueous medium, emulsifying the mixture to form spherical colored particles, and then withdrawing the said particles dispersed in the liquid medium in the form of dried powder.

5. The spherically particulate toner according to any one of Clauses 1 to 3, wherein said particulate toner is obtained by a process which comprises allowing a polymerizable monomer having a colorant dispersed therein to undergo polymerization in a liquid medium to form spherical colored particles, and then withdrawing the said particles dispersed in the liquid medium in the form of dried powder.

6. A spherically particulate color toner comprising a colorant and a binder resin, wherein said toner has a volume-average particle diameter of from 1 to 6 μm and an average circularity (average of circularity defined by (perimeter of circle having the same area as the projected area of particle)/(perimeter of the projected image of particle)) of not less than 0.98 and said colorant is an organic chromatic pigment and the content thereof is not less than 5% by weight based on the total weight of the binder resin and the colorant.

7. The spherically particulate color toner according to Clause 6, having a particle size distribution such that the ratio of 50%-volume particle diameter/50%-number particle diameter is not more than 1.25 and the square root of the ratio of 84%-volume particle diameter/16%-volume particle diameter is not more than 1.25 and comprising the colorant encapsulated in the binder resin.

8. The spherically particulate color toner according to Clause 7, comprising inorganic oxide fine particles externally added to the surface thereof in an amount represented by the following general formula:

$$3.5714X^{-0.9942} \leqq Y \leqq 31.399X^{-0.9477}$$

wherein X represents a volume-average particle diameter ($\mu$m) of toner particles; and Y represents an added amount (wt-%) of inorganic oxide fine particles based on the weight of toner particles.

9. The spherically particulate color toner according to any one of Clauses 6 to 8, wherein said colorant is an organic chromatic pigment and said binder resin is an acid group-containing polyester resin.

10. The spherically particulate color toner according to any one of Clauses 6 to 8, wherein said particulate toner is obtained by mixing an organic solvent solution comprising a colorant and a water-insoluble binder resin as essential components and an aqueous medium, emulsifying the mixture to form spherical colored particles, and then withdrawing the said particles dispersed in the liquid medium in the form of dried powder.

11. The spherically particulate color toner according to any one of Clauses 6 to 8, wherein said particulate toner is obtained by a process which comprises allowing a polymerizable monomer having a colorant dispersed therein to undergo polymerization in a liquid medium to form spherical colored particles, and then withdrawing the said particles dispersed in the liquid medium in the form of dried powder.

12. The spherically particulate toner according to Clause 1 or 6, wherein said particulate toner is obtained by emulsifying an organic solvent solution comprising a colorant and a water-insoluble acid group-containing polyester resin as essential components and an aqueous medium under a high shearing action in the presence of a basic neutralizer to form colorant-containing fine particles, further stirring the fine particles so that they associate to form spherical colored particles having a greater particle diameter than said fine particles comprising a colorant encapsulated therein, and then withdrawing the said associated particles dispersed in the liquid medium in the form of dried powder.

DETAILED DESCRIPTION OF THE INVENTION

The inventors made extensive studies of small particle diameter powder toner excellent in triboelectricity, image density, resolution and so on. As a result, it was found that the foregoing objects of the present invention can be accomplished by the use of a particulate toner comprising a colorant and a binder resin as essential components, an average circularity of not less than 0.98 and a volume-average particle diameter of from 1 to 6 $\mu$m, preferably from 2 to 6 $\mu$m, wherein the content of said colorant is not less than 9.1% by weight, particularly not less than 5% by weight if said colorant is an organic chromatic pigment, based on the total weight of the binder resin and the colorant used.

It was also found that a spherically particulate toner having a particle size distribution such that the ratio of 50%-volume particle diameter/50%-number particle diameter is not more than 1.25 and the square root of the ratio of 84%-volume particle diameter/16%-volume particle diameter is not more than 1.25 and comprising a colorant encapsulated in a binder resin can cause little fogging as compared with the foregoing powder toner which doesn't meet these requirements to advantage. It was further found that the foregoing particulate toner comprising inorganic oxide fine particles externally added to the surface thereof in an amount represented by the following general formula is advantageous particularly in fluidity or triboelectricity:

$$3.5714X^{-0.9942} \leqq Y \leqq 31.399X^{-0.9477}$$

wherein X represents a volume-average particle diameter ($\mu$m) of toner particles; and Y represents an added amount (wt-%) of inorganic oxide fine particles based on the weight of toner particles.

It was further found that the present invention is advantageous particularly when the foregoing powder toner comprises carbon black as a colorant and a styrene (meth) acrylate resin or polyester resin as a binder resin.

It was further found that the foregoing powder toner obtained by a process which comprises mixing an organic solvent solution comprising a colorant and a water-insoluble binder resin as essential components and an aqueous medium, emulsifying the mixture to form spherical colored fine particles, and then withdrawing the said particles dispersed in the liquid medium in the form of dried powder or a process which comprises allowing a polymerizable monomer having a colorant dispersed therein to undergo polymerization in a liquid medium to form spherical colored fine particles, and then withdrawing the said particles dispersed in the liquid medium in the form of dried powder exhibits a better particle size distribution and an excellent triboelectricity and thus can form a good image. Thus, the present invention has been worked out.

The small particle diameter toner of the present invention can be used as either a one-component developer or a two-component developer in electrophotographic process. Alternatively, the small particle diameter toner of the present invention can be used as a developer for toner jetting printer.

The background and detailed description of the present invention will be further described hereinafter.

The process for the reduction of the particle diameter of toner particles by pulverization method is liable to sudden rise in crushing energy cost which appears when the volume-average particle diameter of toner particles is reduced to about 6 $\mu$m. Further, the resulting toner particles are amorphous, providing a toner having deteriorated triboelectricity or powder fluidity. This hinders the realization of a particulate toner having a particle diameter as small as not more than about 6 $\mu$m.

It was found that the deterioration of powder fluidity by the reduction of the particle diameter of toner particles can be drastically inhibited by rendering the shape of the toner particles spherical. It was further found that the particulate toner having a volume-average particle diameter of from 1 to 6 $\mu$m, preferably from 2 to 6 $\mu$m, for which the present invention is intended needs to have an average circularity of not less than 0.98, preferably not less than 0.985. The average circularity can be determined by taking SEM (scanning electron microphotograph) of the toner particles, measuring the size of the toner particles thereon, and then calculating the measurements. However, the average circularity can be easily determined by the use of a Type FPIP-1000 flow type particle image analyzer produced by Toa Iyo Denshi K.K. In the present invention, this analyzer was used.

The inventors conjectured that the deterioration of triboelectricity accompanying the reduction of the particle diameter of toner particles is attributed to the exposure of a part of the colorant or other additives (e.g., wax, charge control agent) at the surface of the toner particles. In other words, even if the content of colorant, etc. is the same, toner particles having a reduced particle diameter have an increased surface area. Thus, the proportion of colorant and other additives exposed at the surface of the toner particles is increased. As a result, the composition of the surface of the toner particles show a drastic change that causes a drastic change in the triboelectricity of the toner particles, making it difficult to control the triboelectricity of the toner.

The inventors found that it is effective to prevent the colorant or other additives from being exposed at the surface of the toner particles, i.e., use a toner structure comprising the colorant or other additives encapsulated in the toner particles in order to keep the triboelectricity of the toner particles good even if the particle diameter of the toner particles is reduced.

If the colorant, charge control agent, wax or the like are exposed at the surface of the toner particles or not can be easily judged by observing a section of the toner particle by TEM (transmission type electronmicroscope). In some detail, the toner particle of the present invention is embedded in a resin. The embedded toner particle is then cut by a microtome. The specimen thus prepared may be dyed with ruthenium oxide or the like. By observing the section of the particle by TEM, the colorant or other additives are found encapsulated and uniformly dispersed in the toner particle.

The particle size distribution of the toner particles, too, has an effect on the triboelectricity of the toner. It was further found that the small particle diameter toner for which the present invention is intended needs to have a sharper particle size distribution than the prior art toners (having a particle diameter of from about 7 to 13 $\mu$m). It was particularly found that the toner having a volume-average particle diameter of from 1 to 6 $\mu$m for which the present invention is intended must. satisfy the requirements that it has a particle size distribution such that the ratio of 50%-volume particle diameter/50%-number particle diameter is not more than 1.25, particularly not more than 1.20 and the square root of the ratio of 84%-volume particle diameter/16%-volume particle diameter is not more than 1.25, particularly not more than 1.23, to exhibit a good triboelectricity and hence provide a high quality printed image free of fog.

The inventors further found that the triboelectricity and powder fluidity of the small particle diameter toner can be even further improved by properly selecting the kind and amount of the inorganic oxide fine particles to be incorporated in the toner. Examples of the material to be used as the inorganic oxide fine particles herein include silica, titanium oxide, aluminum oxide, zinc oxide, tin oxide, antimony oxide, and magnesium oxide. These materials may be used singly or in combination.

Among these inorganic oxides, hydrophobicized silica having a primary particle diameter of from about 5 to 50 nm is particularly preferred. If necessary, silica can be used in combination with other inorganic oxide fine particles to advantage. Many hydrophobic silica products for toner are commercially available. It is practically advantageous to select from these commercially available hydrophobic silica products.

The amount of the inorganic oxide fine particles to be incorporated in the toner depends on the purpose of the toner. In practice, however, the smaller the particle diameter of the toner is, the more should be added to the toner. For the particulate toner having a particle diameter of from 1 to 6 $\mu$m, the inorganic oxide fine particles is preferably added in an amount represented by the following general formula:

$$3.5714X^{-0.9942} \leqq Y \leqq 31.399X^{-0.9477}$$

wherein X represents a volume-average particle diameter ($\mu$m) of toner particles; and Y represents an externally added amount (wt-%) of inorganic oxide fine particles based on the weight of toner particles.

The external addition of the inorganic oxide fine particles can be accomplished by any known commonly used method using a Henschel mixer, hybridizer or the like.

The colorant to be incorporated in the powder toner of the present invention is not specifically limited. In practice, however, any colorant which has heretofore been used for electrophotographic toner may be used. Preferred among these colorants are pigments.

Examples of black pigments include carbon black, cyanine black, aniline black, ferrite, and magnetite. Alternatively, pigments prepared by processing the following organic chromatic pigments so that they are rendered black may be used. However, carbon black is preferred.

Examples of yellow pigments include chrome yellow, zinc yellow, cadmium yellow, Hydrated Yellow, yellow ochre, Titanium Yellow, naphthol yellow S, Hansa Yellow 10G, Hansa Yellow 5G, Hansa Yellow G, Hansa Yellow GR, Hansa Yellow A, Hansa Yellow RN, Hansa Yellow R, pigment yellow L, benzidine yellow, benzidine yellow G, benzidine yellow GR, permanent yellow NCG, vulcan fast yellow 5G, vulcan fast yellow R, quinoline yellow lake, anthragen yellow 6GL, permanent yellow FGL, permanent yellow H10G, permanent yellow HR, anthrapyrimidine yellow, other isoindolinone yellow, chromophthal yellow, novoperm yellow H2G, condensed azo yellow, nickel azo yellow, and copper azomethylene yellow.

Examples of red pigments include red chrome yellow, molybdenum orange, permanent orange GRR, pyrazolone orange, vulcan orange, indathrene brilliant orange RK, indathrene brilliant orange GK, benzidine orange G, permanent red 4R, permanent red BL, permanent red F5RK, lithol red, pyrazolone red, watching red, lake red C, lake red D, brilliant carmine 6B, brilliant carmine 3B, rhodamine lake B, alizarine lake, permanent carmine FBB, perinone orange, isoindolinone orange, anthroanthrone orange, pyrathrone orange, quinacridone red, quinacridone magenta, quinacridone scarlet, and perylene red.

Examples of blue pigments include cobalt blue, cerulean blue, alkali blue lake, peacock blue lake, fanatone blue 6G, victoria blue lake, metal-free phthalocyanine blue, copper phthalocyanine blue, fast sky blue, indathrene blue RS, indathrene blue BC, and indigo.

The thickness of a toner image layer printed with the prior art toner by electrophotographic process is very thicker than that of an ink image layer printed with a lithographic printing ink. Thus, it is effective to reduce the thickness of the printed toner image layer in order to improve the quality of an image printed by electrophotographic process. It is well known that the use of a particulate toner having a reduced particle diameter normally provides a printed toner image layer having a reduced thickness. However, the reduction of the thickness of the toner layer is accompanied by the reduction of the density of the printed image. Thus, studies have been made from a point of view that it is dispensable to predetermine the colorant concentration higher than that of toners having a particle diameter of from 7 μm to 13 μm in order to provide a sufficient printed image density with a toner having a particle diameter as small as from 1 to 6 μm for which the present invention is intended. As a result, it was found that the spherically particulate toner having a particle diameter of from 1 to 6 μm of the present invention can comprise a colorant in an amount of not less than 9.1% by weight based on the total weight of the binder resin and colorant used to provide the required image density. The colorant, if it is carbon black, can be incorporated in the toner in an amount of from 9.1 to 15% by weight to advantage in particular.

It was also found in the case where yellow, magenta and cyan toners having a particle diameter of from 1 to 6 μm of the present invention each comprise an organic chromatic pigment incorporated therein as a colorant that if the colorant is incorporated in the toner in an amount of not less than 5% by weight, preferably not less than 5.5% by weight, based on the total weight of the binder resin and colorant used, the thickness of the printed toner image layer can be reduced while maintaining the desired printed image density.

Theoretically speaking, the spherically particulate toner having a particle diameter of from 1 to 6 μm comprising a colorant encapsulated in toner particles according to the present invention can be obtained, e.g., by treating amorphous particles prepared by pulverization method with a resin so that they are rendered spherical. In practice, however, a wet process such as polymerization process and emulsification process can be actually employed to advantage from the standpoint of ease of production and cost. In particular, emulsification process is suitable for the preparation of the toner of the present invention because various binder resins can be used and the pigment concentration can be easily raised.

An emulsification process for the preparation of a particulate toner which can be used as the toner of the present invention will be described hereinafter. In some detail, an organic solvent solution comprising a colorant and a water-insoluble binder resin as essential components and an aqueous medium are mixed and emulsified to form spherical colored resin particles. The organic sclvent is then removed from the particles. The particles dispersed in the aqueous medium are then withdrawn in the form of dried powder. If necessary, the particles are then classified to adjust the particle size distribution thereof. Thus, the desired particulate toner is obtained. In order to form spherical colored particles by emulsification, a method free from organic solvent may be used as described in U.S. Pat. No. 5,843,614. The toner can be used as spherically particulate toner of the present invention. In practice, however, the former process using an organic solvent is preferred in the present invention because a high molecular resin can be used as a binder resin and a better particle size distribution can be easily provided.

Examples of the foregoing organic solvent to be used in the dissolution of the binder resin and the dispersion of the colorant and other additives include hydrocarbons such as pentane, hexane, heptane, benzene, toluene, xylene, cyclohexane and petroleum ether; halogenated hydrocarbons such as methylene chloride, chloroform, dichloroethane, dichloroethylene, trichloroethane, trichloroethylene and carbon tetrachloride; alcohols such as methanol, ethanol, isopropyl alcohol, n-propyl alcohol and butanol; ketones such as acetone, methyl ethyl ketone and methyl isobutyl ketone; and esters such as ethyl acetate and butyl acetate. Two or more of these organic solvents may be used in admixture.

The foregoing binder resin to be used herein is not specifically limited so far as it is soluble in the foregoing organic solvent. In practice, however, a water-insoluble resin which cannot itself be dispersed in an aqueous medium but can be dispersed in an aqueous medium only in the presence of an emulsifying agent or dispersion stabilizer or a self-water dispersible water-insoluble resin which can itself be dispersed in an aqueous medium may be used.

Examples of such a water-insoluble resin for toner include styrene resin, (meth)acrylic resin, polyester resin, polyurethane resin, and epoxy resin. Particularly preferred among these water-insoluble resins is styrene (meth)acrylate resin obtained by the polymerization of a styrene monomer and a (meth)acrylic acid ester as essential components. Examples of (meth)acryl employable herein include methacryl and acryl.

As the foregoing resin there may be preferably used one having a normal weight-average molecular weight of from 3,000 to 300,000, which level is required for the realization of a sufficient mechanical strength, and a glass transition temperature (Tg) of from 50° C. to 100° C. as determined by DSC (differential scanning calorimeter).

Among the foregoing binder resins, the self-water dispersible resin means a resin containing a functional group that can be rendered anionic upon neutralization which can form a stable water dispersion under the action of an aqueous medium free from emulsifying agent or dispersion stabilizer when the functional group that can be rendered hydrophilic is partly or entirely neutralized with a base.

Examples of the functional group which can be rendered hydrophilic upon neutralization include acidic. groups such as carboxyl group, phosphoric acid group and sulfonic acid group. Examples of the resin containing such a functional group include styrene resin, (meth)acrylic resin, polyester resin, polyurethane resin, and epoxy resin. Preferred among these resins is styrene (meth)acrylate resin containing an acidic group.

As a suitable anionic styrene (meth)acrylate resin which can be rendered self-water dispersible upon neutralization there may be used one obtained by the radical polymerization of a styrene monomer such as (meth)acrylic polymerizable vinyl monomer containing an acid group as an essential component with a polymerizable vinyl monomer other than the polymerizable vinyl monomer containing an acid group such as (meth)acrylic acid ester in the presence of a radical polymerization initiator. The polymerization reaction for this purpose can be effected properly in the form of solution polymerization, suspension polymerization or emulsion polymerization.

Examples of such an acid group-containing (meth)acrylic polymerizable monomer include acrylic acid, methacrylic acid, crotonic acid, itaconic acid, maleic acid, fumaric acid, monobutyl itaconate, and monobutyl maleate.

As the polymerizable monomer other than acid group-containing polymerizable monomer there may be used a styrenic monomer (aromatic vinyl monomer) such as styrene, vinyl toluene, 2-methylstyrene, t-butylstyrene, and chlorostyrene.

Examples of the acrylic acid ester include methyl acrylate, ethyl acrylate, isopropyl acrylate, n-butyl acrylate, isobutyl acrylate, n-amyl acrylate, isoamyl acrylate, n-hexyl acrylate, 2-ethylhexyl acrylate, n-octyl acrylate, decyl acrylate, dodecyl acrylate, 2-chloroethyl acrylate, phenyl acrylate, and methyl alfachloroacrylate.

Examples of the methacrylic acid ester include methyl methacrylate, propyl methacrylate, n-butyl methacrylate, isobutyl methacrylate, n-amyl methacrylate, n-hexyl methacrylate, 2-ethylhexyl methacrylate, n-octyl methacrylate, decyl methacrylate, dodecyl methacrylate, 2-chloroethyl methacrylate, phenyl methacrylate, and methyl alphachloromethacrylate.

Further examples of the polymerizable monomer other than acid group-containing polymerizable monomer include acrylic acid or methacrylic acid derivatives such as acrylonitrile, methacrylonitrile and acrylamide, vinyl ethers such as vinyl methyl ether, vinyl ethyl ether and vinyl isobutyl ether, vinyl ketones such as vinyl methyl ketone, vinyl hexyl ketone and methyl isopropenyl ketone, and N-vinyl compounds such as N-vinylpyrrole, N-vinylcarbazole, N-vinylindole and N-vinylpyrrolidone.

For the preparation of the resin which can be rendered self-water dispersible upon neutralization, a general-purpose organic solvent may be used if solution polymerization is effected. Specific examples of such an organic solvent include inert solvents such as various aromatic hydrocarbons (e.g., toluene, xylene, benzene), various alcohols (e.g., methanol, ethanol, propanol, butanol), various ether alcohols (e.g., cellosolve, carbitol), various ketones (e.g., acetone, methyl ethyl ketone, methyl isobutyl ketone), various esters (e.g, ethyl acetate, butyl acetate) and various ether esters (e.g., butyl cellosolve acetate).

As the polymerization initiator to be used herein there may be used any known commonly used organic peroxide initiator or azo initiator. Specific examples of these initiators include peroxides such as benzoyl peroxide, cumene hydroperoxide, t-butyl hydroperoxide, sodium persulfate and ammonium persulfate, and azo compounds such as azobisobutylonitrile and azobisisovaleronitrile.

The content of carboxyl group in the carboxyl group-containing anionic resin which can be rendered hydrophilic upon neutralization is not specifically limited. If the carboxyl group-containing anionic resin is a styrene (meth) acrylic resin, it preferably has an acid value (mg of KOH required to neutralize 1 g of resin) of from 30 to 150.

The toner of the present invention may comprise any known commonly used polyester resin incorporated therein as a binder resin. As such a polyester resin there may be used one obtained by the reaction of a polyhydric alcohol with a polybasic acid or ester-forming derivative thereof.

The polyester resin which can be preferably used herein can be prepared by the dehydropolycondensation of a polybasic acid with a polyhydric alcohol as starting materials in the presence of a catalyst in the presence or absence of solvent. The polybasic acid may be partly subjected to demethanolization polycondensation with its methylesterification product thereof as one of its ester-forming derivatives.

More specifically, an aromatic polyester resin obtained by the reaction of an aromatic dicarboxylic acid such as phthalic acid or its ester-forming derivative as an essential component is preferred. The emulsification process may be effected using a binder resin soluble in the solvent used.

Examples of the polybasic acid employable herein include aromatic carboxylic acids such as terephthalic acid, isophthalic acid, phthalic anhydride, trimellitic anhydride, pyromellitic acid and naphthalenedicarboxylic acid, aliphatic carboxylic acids such as maleic anhydride, fumaric acid, succinic acid, alkenyl succinic anhydride and adipic acid, and alicyclic carboxylic acids such as cyclohexane dicarboxylic acid. These polybasic acids may be used singly or in combination.

Examples of the polyhydric alcohol employable herein include aliphatic diols such as ethylene glycol, propylene glycol, butanediol, hexanediol, neopentyl glycol and glycerin, alicyclic diols such as cyclohexanediol, cyclohexane dimethanol and hydrogenated bisphenol A, and aromatic diols such as ethylene oxide addluct of bisphenol A and propylene oxide adduct of bisphenol A. These polyhydric alcohols may be used singly or in combination.

The glass transition point of the polyester resin is preferably from 50° C. to 75° C., more preferably from 55° C. to 70° C. If the glass transition point of the polyester resin falls below 50° C., the resulting toner exhibits an insufficient heat resisting cohesiveness. On the contrary, if the glass transition point of the polyester resin exceeds 75° C., the resulting toner exhibits a deteriorated fixability to disadvantage.

The acid group content in the polyester resin can be properly adjusted by selecting the mixing proportion and percent conversion of the foregoing polybasic acid and polyhydric alcohol so that the carboxyl group by which the polyester is terminated is controlled. Alternatively, trimellitic anhydride can be used as a polybasic acid component to obtain a polyester resin comprising a carboxyl group incorporated in its main chain. In the toner of the present invention, the polyester resin preferably has an acid value of from 1 to 30.

The basic neutralizing agent for rendering the foregoing acid group-containing styrene (meth)acrylate resin or polyester resin self-water dispersible is not specifically limited. In practice, however, an inorganic alkali such as sodium hydroxide, potassium hydroxide, lithium hydroxide, calcium hydroxide, sodium carbonate and ammonia or an organic base such as diethylamine, triethylamine and isoproplylamine may be used.

A process for the preparation of a spherically particulate toner suitable as the toner of the present invention will be described hereinafter which comprises emulsifying a mixture comprising an acid group-containing polyester resin, a colorant and a hydrophobic organic solvent which can dissolve or disperse the polyester resin as essential components and an aqueous medium under a high shearing action in the presence of a basic neutralizer to form colorant-containing fine particles, further stirring the particles so that they associate to form spherical colored particles comprising a colorant encapsulated therein, and then withdrawing the said particles dispersed in the liquid medium in the form of dried powder (hereinafter referred to as "emulsification dispersion association process").

For the formation of finely divided particles at the first step, any known commonly used emulsification disperser capable of controlling the particle diameter to a range of from 0.5 to 5 $\mu$m can be used. In practice, however, an emulsification disperser of the type comprising a rotor which rotates at a high speed and a stator portion engaged therewith whereby the components are mixed and stirred under the action of a shearing force developed by a high speed flow caused by cavitation, a shearing force developed at the rotary portion and a shearing force developed by the collision of high speed flows is preferred. Examples of such an emulsification disperser include Homomixer (produced by Tokushu Kika Kogyo Co., Ltd.), Slasher (produced by MITSUI MINING CO., LTD.) and Cavitron (Eurotec, Ltd.). In other words, as a high shearing force there is preferably used a high complex shearing force developed by some phenomena such as rotation, pressure drop and collision.

The finely divided particles produced at the first step have a particle diameter of from 0.5 to 5 $\mu$m and the distribution of which is preferably sharp. By thus controlling, the amount of fine particles left after association can be reduced and less coarse particles can be produced, making it possible to obtain a good particulate toner.

Referring to the step for associating the finely divided particles produced at the first step into greater particles, association is preferably effected under the same shearing action as used in the first emulsification step.

The control over the particle diameter at the association step can be carried out by stirring time or the like. In this manner, the particulate toner having a particle diameter of from 1 to 6 $\mu$m of the present invention, which is greater than that of the finely divided particles obtained at the first step, can be easily obtained. The termination of association can be accomplished by lowering or eliminating the shearing force, diluting the liquid medium with water or adding a neutralizing agent to the mixture. The reduction of shearing force can be effected so that the shearing force reaches not greater than 6 m/s if the apparatus for emulsification association is the foregoing suitable emulsion disperser having a rotor. Alternatively, the liquid medium containing particles may be diluted with water so that the solid content reaches not more than 20%. For the purpose of lowering the percent neutralization of carboxyl group and hence increasing the dispersion stability in the liquid medium, a neutralizing agent may be added in an amount required to neutralize the carboxyl group by 10 to 50 mol-%.

This emulsion dispersion association process is suitable for the preparation of the particulate toner of the present invention because the eluted amount of water-soluble resin components in the aqueous medium can be reduced to obtain a particulate toner having almost the same thermal properties as the polyester resin used and the produced amount of coarse particles can be reduced to obtain a particulate toner having a good particle size distribution. Thus, an emulsification dispersion association process for the preparation of a particulate toner has been described.

In the emulsion process for the preparation of a particulate toner according to the present invention, if as a binder resin there is used a non-self-water dispersible water-insoluble resin, it is necessary that the resin solution and/or aqueous medium to be mixed therewith (The term "aqueous medium" as used is meant to indicate water or a liquid medium mainly composed of water) be used in admixture with an emulsifier and/or dispersion stabilizer.

As the dispersion stabilizer there is preferably used a water-soluble polymer compound. Examples of such a water-soluble polymer compound include polyvinyl alcohol, polyvinyl pyrrolidone, hydroxyethyl cellulose, and carboxymethyl cellulose. Examples of the emulsifier employable herein include nonionic surface active agents such as polyoxyethylene alkyl phenol ether, anionic surface active agents such as sodium alkylbenzenesulfonate, and cationic surface active agents. Of course, two or more of these emulsifiers may be used in combination. Alternatively, two or more of these dispersion stabilizers may be used in combination. Emulsifiers and dispersion stabilizers may be used in combination. In general, however, a dispersion stabilizer is mainly used in combination with an emulsifier.

The emulsifier or dispersion stabilizer, if any, is preferably used in a concentration of from about 0.5 to 3% by weight based on the weight of the aqueous medium.

Even if the foregoing resin which can be rendered self-water dispersible upon neutralization is used, an emulsion and/or dispersion stabilizer may be used as necessary so far as it doesn't impair the effect of the present invention.

If necessary, the spherically particulate toner of the present invention may comprise a charge control agent such as metal-containing azo compound and salicylic metal complex or a wax such as polyethylene wax, polypropylene wax and paraffin wax incorporated therein in an amount of from 0.1 to 10% by weight based on the weight of the binder resin used.

The incorporation of these additives or the foregoing colorant can be accomplished by the addition of these additives to an organic solvent solution of the binder resin which is then subjected to mixing and dispersion by an ordinary mixer or disperser such as ball mill and continuous bead mill.

The dispersion of spherical colored resin particles thus obtained by emulsification is then subjected to distillation or the like so that the organic solvent is removed therefrom. The resulting aqueous dispersion is then withdrawn by filtration or other means. The wet cake thus obtained is then dried to obtain a particulate toner. The colored resin particles obtained with an emulsifier or dispersion stabilizer is preferably washed more thoroughly before use.

In the case where spherical colored resin particles are obtained with a self-water dispersible resin obtained by neutralizing an acid group-containing water-insoluble resin with a basic neutralizing agent as a binder resin, the particles which have been freed of organic solvent is preferably subjected to reverse neutralization of the functional group on the surface thereof which has been neutralized with the basic neutralizing agent with an acidic neutralizing agent such as hydrochloric acid, sulfuric acid, phosphoric acid, acetic acid and oxalic acid so that the hydrophilicity thereof is further lowered before filtration and drying.

Drying can be accomplished by any known commonly used method. For example, the toner particles may be dried under normal or reduced pressure at a temperature such that the toner particles are not heat-fused or agglomerated. Alternatively, the toner particles may be subjected to freeze-drying. Particularly preferred examples of drying methods which can be efficiently conducted include a method involving instantaneous drying in a heated compressed air flow using a Flush Jet Dryer (produced by Seishin Co., Ltd.) and a method involving drying with heating and stirring under reduced pressure using a Nauter mixer (produced by HOSOKAWA MICRON CORP.).

In the case where classification for removing coarse particles or fine particles is needed to unify the particle size distribution of the particulate toner, any known commonly used method using an ordinary commercially available dry classifier for toner or other purposes may be used. Alternatively, a method may be used involving classification of an aqueous slurry of spherical colored particles using the difference of sedimentation rate by particle diameter. The removal of coarse particles may be accomplished also by filtration of an aqueous slurry of spherical colored particles through a filter having a proper pore size.

A polymerization process for the preparation of a particulate toner suitable for the present invention will be described hereinafter. This process involves polymerization of a polymerizable monomer having a colorant dispersed therein in a liquid medium to form spherical colored resin particles, followed by the withdrawal of the particles dispersed in the liquid medium in the form of dried powder which is then optionally subjected to classification to obtain a spherically particulate toner having a unified particle size distribution.

In some detail, a colorant and a reactive monomer capable of forming a binder resin are suspended or emulsion-dispersed in a, liquid medium in the presence of a dispersion stabilizer cr emulsifier. The suspension or dispersion thus formed is then subjected to polymerization reaction by radical polymerization with stirring in the presence of a polymerization initiator to obtain an aqueous dispersion of spherical toner particles having a colorant encapsulated in a binder resin.

Specific examples of the radical-polymerizable monomer employable herein include acryl monomers such as styrene (e.g., styrene, α-methylstyrene, chlorostyrene, vinylstyrene), monoolefin (e.g., ethylene, propylene, butylene, isobutylene), vinyl ester (e.g., vinyl acetate, vinyl propionate, vinyl butyrate, vinyl benzoate), α-methylenealiphatic monocarboxylic acid ester (e.g., methyl acrylate, ethyl acrylate, butyl acrylate, octyl acrylate, dodecyl acrylate, phenyl acrylate, methyl methacrylate, ethyl methacrylate, butyl methacrylate, dodecyl methacrylate), glycolmono(meth)acrylic acid ester (e.g., ethyleneglycol monoacrylate, propyleneglycol monoacrylate, tetramethylene ether glycol monoacrylate), vinyl ether (e.g., vinyl methyl ether, vinyl ethyl ether, vinyl butyl ether), and vinyl ketone (e.g., vinyl methyl ketone, vinyl hexyl ketone, vinyl propenyl ketone). These radical-polymerizable monomers may be used singly or in combination.

The monomer composition constituting the binder resin is prepared such that the resulting polymer exhibits a glass transition temperature (Tg) of from 50° C. to 80° C.

If necessary, these monomers may be used in combination with a small amount of a reactive monomer having two or more ethylenically unsaturated double bonds. Examples of such a reactive monomer having two or more ethylenically unsaturated double bonds include conjugated diene such as butadiene and isoprene, divinyl benzene, di(meth)acrylate of bisphenol A-alkylene oxide adduct, trimethylolpropane tri (meth)acrylate, and pentaerythritol tetra(meth)acrylate.

As the polymerization initiator for use in the preparation of such a resin, there may be, of course, used any ordinary oil-soluble or water-soluble polymerization initiator. Examples of such an oil-soluble or water-soluble polymerization initiator include various oxides such as benzoyl peroxide, di-t-butyl peroxide, cumene hydroperoxide, t-butyl peroxide and 2-ethyl hexanoate, and various azo compounds such as azobisisobutylonitrile and azobisisovaleronitrile.

For suspension polymerization, a polymerization initiator insoluble in the liquid medium used but soluble in the monomer used may be selected. For emulsion polymerization, a water-soluble polymerization initiatormay be selected. The amount of the polymerization initiator to be used is not specifically limited. In practice, however, it may be from 0.01 to 5 parts by weight based on 100 parts by weight of all the reactive monomers used.

The binder resin formed by polymerization may be arbitrarily adjusted by polymerization conditions or the like. Preferably, the binder resin is adjusted to have a weight-average molecular weight of from 10,000 to 500,000.

As the colorant, charge control agent and wax to be incorporated in the particulate toner there may be used any known commonly used materials similarly to the foregoing emulsification process toner.

As the dispersion stabilizer to be used in suspension polymerization there may be normally used a water-soluble polymer compound. Examples of such a water-soluble polymer compound include polyvinyl alcohol, polyvinyl pyrrolidone, hydroxyethyl cellulose, carboxylmethyl cellulose, cellulose gum, and so on.

Further, an inorganic water-insoluble particulate material having a particle diameter of from 0.01 to 5 μm, too, may be used as a suspension dispersion stabilizer. Examples of such a material include tricalcium phosphate, talc, bentonite, kaolin, titanium oxide, alumina, zinc white, aluminum hydroxide, magnesium hydroxide, basic magnesium silicate, titanium hydroxide, ferric hydroxide, barium sulfate, silica, magnesium carbonate, and calcium carbonate.

These dispersion stabilizers may be used singly or in combination. The amount of such a dispersion stabilizer to be used is normally from 0.1 to 10 parts by weight based on 100 parts by weight of all the reactive monomers.

Examples of the emulsifying agent to be used in emulsion polymerization include anionic surface active agents such as sodium dodecylbenzenesulfonate, sodium laurylsulfate and sodium dodecyldiphenyloxidedisulfonate, and nonionic surface active agents such as polyoxyethylene lauryl ether and polyoxyethylene nonyl phenol ether. These emulsifying agents may be used singly or in combination. The amount of the emulsifying agent to be used is normally from 0.01 to 5 parts by weight based on 100 parts by weight of all the reactive monomers.

For suspension polymerization, the dispersion stabilizer may be used in combination with a small amount of an emulsifying agent. Alternatively, for emulsion polymerization, the emulsifying agent may be used in combination with a small amount of a dispersion stabilizer. The foregoing dispersion stabilizer or emulsifying agent may be replaced by a self-emulsifiable epoxy resin or self-emulsifiable polyurethane resin.

The foregoing polymerizable monomer, colorant, dispersion stabilizer, liquid medium and polymerization initiator may be simultaneously added and stirred to polymerize monomer droplets. Alternatively, the polymerizable monomer and colorant may be thoroughly mixed, and then added to a liquid medium containing a polymerization initiator and a dispersion stabilizer. The mixture is then stirred by a homogenizer, rotor stator type mixer, static mixer or the like so that droplets of the monomer comprising a polymerizable monomer as essential component is suspended in a liquid medium. The mixture is further stirred to undergo polymerization.

Examples of the liquid medium to be used in polymerization include water such as distilled water and ion-exchanged water, various aromatic hydrocarbons such as toluene, xylene andbenzene, various alcohols such as methanol, ethanol, propanol and butanol, various alcohols such as cellosolve and carbitol, various ketones such as acetone, methyl ethyl ketone and methyl isobutyl ketone, various esters such as ethyl acetate and. butyl acetate, and various ether esters such as butyl cellosolve acetate.

In any of the foregoing polymerization processes, core-shell polymerization, power feed polymerization or graft polymerization may be employed to vary the chemical structure or layer structure of the particles. The reaction conditions under which the foregoing various suspension polymerization processes or emulsion polymerization processes of the present invention are effected are not specifically limited. In practice, however, the reaction is effected at a temperature of from room temperature to 80° C. for 15 minutes to 24 hours.

The dispersion of spherical colored resin particles thus obtained may then be freed of liquid medium and dried to easily obtain a spherically particulate colored resin in the form of powder. In order to remove the dispersion stabilizer or emulsifying agent from the foregoing dispersion, it is preferred that the dispersion be repeatedly washed. The operation such as drying and classification is effected in the same manner as in the preparation of emulsion process toner particles.

The toner of the present invention obtained according to the foregoing various processes may be used for either one-component development or two-component development.

The present invention provides the foregoing novel toners:

1. A spherically particulate toner comprising a colorant and a binder resin, wherein said toner has a volume-average particle diameter of from 1 to 6 μm, the content of the colorant is not less than 9.1% by weight based on the total weight of the binder resin and the colorant, and said toner has an average circularity of not less than 0.98.

2. The spherically particulate toner according to Clause 1, having a particle size distribution such that the ratio of 50%-volume particle diameter/50%-number particle diameter is not more than 1.25 and the square root of the ratio of 84%-volume particle diameter/16%-volume particle diameter is not more than 1.25 and comprising the colorant encapsulated in the binder resin.

3. The spherically particulate toner according to Clause 1, comprising inorganic oxide fine particles externally added to the surface thereof in an amount represented by the following general formula:

$$3.5714X^{-0.9942} \leqq Y \leqq 31.399X^{-0.9477}$$

wherein X represents a volume-average particle diameter (μm) of toner particles; and Y represents an added amount (wt-%) of the inorganic oxide fine particles based on the weight of toner particles.

4. The spherically particulate toner according to any one of Clauses 1 to 3, wherein said particulate toner is obtained by mixing an organic solvent solution comprising a colorant and a water-insoluble binder resin as essential components and an aqueous medium, emulsifying the mixture to form spherical colored particles, and then withdrawing the said particles dispersed in the liquid medium in the form of dried powder.

5. The spherically particulate toner according to any one of Clauses 1 to 3, wherein said particulate toner is obtained by a process which comprises allowing a polymerizable monomer having a colorant dispersed therein to undergo polymerization in a liquid medium to form spherical colored particles, and then withdrawing the said particles dispersed in the liquid medium in the form of dried powder.

6. A spherically particulate color toner comprising a colorant and a binder resin, wherein said toner has a volume-average particle diameter of from 1 to 6 μm and an average circularity of not less than 0.98 and said colorant is an organic chromatic pigment and the content thereof is not less than 5% by weight based on the total weight of the binder resin and the colorant.

7. The spherically particulate color toner according to Clause 6, having a particle size distribution such that the ratio of 50%-volume particle diameter/50%-number particle diameter is not more than 1.25 and the square root of the ratio of 84%-volume particle diameter/16%-volume particle diameter is not more than 1.25 and comprising the colorant encapsulated in the binder resin.

8. The spherically particulate color toner according to Clause 7, comprising inorganic oxide fine particles externally added to the surface thereof in an amount represented by the following general formula:

$$3.5714X^{-0.9942} \leqq Y \leqq 31.399X^{-0.9477}$$

wherein X represents a volume-average particle diameter (μm) of toner particles; and Y represents an added amount (wt-%) of inorganic oxide fine particles based on the weight of toner particles.

9. The spherically particulate color toner according to any one of Clauses 6 to 8, wherein said colorant is an organic chromatic pigment and said binder resin is an acid group-containing polyester resin.

10. The spherically particulate color toner according to any one of Clauses 6 to 8, wherein said particulate toner is obtained by mixing an organic solvent solution comprising a colorant and a water-insoluble binder resin as essential components and an aqueous medium, emulsifying the mixture to form spherical colored particles, and then withdrawing the said particles dispersed in the liquid medium in the form of dried powder.

11. The spherically particulate color toner according to any one of Clauses 6 to 8, wherein said particulate toner is obtained by a process which comprises allowing a polymerizable monomer having a colorant dispersed therein to undergo polymerization in a liquid medium to form spherical colored particles, and then withdrawing the said particles dispersed in the liquid medium in the form of dried powder.

12. The spherically particulate toner according to Clause 1 or 6, wherein said particulate toner is obtained by emulsifying an organic solvent solution comprising a colorant and a water-insoluble acid group-containing polyester resin as essential components and an aqueous medium under a high shearing action in the presence of a basic neutralizer to form colorant-containing fine particles, further stirring the fine particles so that they associate to form spherical colored particles having a greater particle diameter than said fine particles comprising a colorant encapsulated therein, and then withdrawing the said associated particles dispersed in the liquid medium in the form of dried powder.

EXAMPLE

The present invention will be further described in the following resin synthesis examples, examples and comparative examples. The "parts" and "%" as used hereinafter are all by weight.

Resin Synthesis Example 1

650 parts of methyl ethyl ketone were charged into a reaction vessel. The reaction material was heated to a temperature of 80° C. To the reaction material was then added dropwise a mixture having the following composition in about 2 hours. This reaction was effected in a flow of nitrogen.

| | |
|---|---|
| Acrylic acid | 77 parts |
| Styrene | 600 parts |
| 2-Ethylhexyl acrylate | 143 parts |
| Methyl methacrylate | 180 parts |
| "Perbutyl O" (produced by NOF Corp.) | 8 parts |
| Methyl ethyl ketone | 20 parts |

Four hours after the termination of the dropwise addition of the foregoing mixture, 2 parts of Perbutyl O were added to the reaction mixture. Thereafter, 2 parts of Perbutyl O were added to the reaction mixture every four hours. Thus, the reaction mixture was kept at a temperature of 80° C. for 24 hours during which the reaction proceeded. After the termination of the reaction, the reaction solution was diluted with methyl ethyl ketone so that the solid resin content reached 50% to obtain a solution of a copolymer having a weight-average molecular weight of 52,000. This was a methyl ethyl ketone solution of a resin having an acid value of 60 and a glass transition temperature of 70° C. which can be rendered anionic self-water dispersible upon neutralization.

Example 1

To 700 parts of a resin solution obtained in Resin Synthesis Example 1 the nonvolatile content of which had been adjusted to 50% were then added 38.8 parts of carbon black [Elftex-8 produced by Cabot Specialty Chemicals Inc.]. The mixture was then stirred to undergo dispersion.

Subsequently, to 100 parts of the mixture were added 10 parts of a 1 N aqueous solution of caustic soda (NaOH) and 13 parts of isopropyl alcohol. To the mixture were then added dropwise 150 parts of water with stirring to cause phase inversion emulsification. As a result, spherical black resin particles were formed.

Subsequently, the particles were subjected to distillation under reduced pressure to remove the organic solvent therefrom. Thus, an aqueous dispersion was obtained. To the aqueous dispersion was then added a 1 N aqueous solution of hydrochloric acid to adjust the pH value thereof to 2.5. The aqueous slurry was then treated by a centrifugal separator to remove fine powder components therefrom. The aqueous slurry was then passed through a filter (produced by Chisso Filter Co., Ltd.) to remove coarse particles therefrom. The aqueous slurry was filtrated and washed with water to obtain a wet cake. The wet cake thus obtained was heated and dried with stirring under reduced pressure to obtain spherical black resin particles (pigment content: 10%) comprising a styrene (meth)acrylate resin as a binder resin in the form of powder.

The black resin particles thus obtained had a good particle size distribution such that the volume-average particle diameter thereof is 5.0 $\mu$m, the ratio of 50%-volume particle diameter/50%-number particle diameter thereof is 1.10 and the square root of the ratio of 84%-volume particle diameter/16%-volume particle diameter thereof is 1.21 as determined by Coulter Multisizer. The black resin particles had an average circularity of 0.989 as determined by a Type FPIP-1000 flow type particle image analyzer produced by Toa Iyo Denshi K.K. The particle was embedded in a resin, cut by a microtome, and then observed at the section by TEM (transmission type electron microscope). As a result, carbon black was found encapsulated and uniformly dispersed in the particle.

To 100 parts of the spherical black resin particles were then externally added 1.1 parts of MT-150 (titanium oxide produced by TAYCA CORP.) and 1.3 parts of a Type Wacker HDK SLM50650 hydrophobic silica by means of a Henschel mixer to prepare a toner.

Example 2

To 700 parts of the resin solution obtained in Resin Synthesis Example 1 the nonvolatile content of which had been adjusted to 50% were added 47.7 parts of carbon black (Elftex-8). The mixture was then stirred to undergo dispersion.

Subsequently, to 100 parts of the mixture were added 11 parts of a 1 N aqueous solution of caustic soda and 13 parts of isopropyl alcohol. To the mixture were then added dropwise 160 parts of water with stirring to cause phase inversion emulsification. As a result, spherical black resin particles were formed.

Subsequently, the particles were processed in the same manner as in Example 1 to obtain spherical black resin particles (pigment content: 12%) comprising a styrene acrylate resin as a binder resin in the form of powder.

The black resin particles thus obtained had a good particle size distribution such that the volume-average particle diameter thereof is 3.8 $\mu$m, the ratio of 50%-volume particle diameter/50%-number particle diameter thereof is 1.11 and the square root of the ratio of 84%-volume particle diameter/16%-volume particle diameter thereof is 1.20. The black resin particles had an average circularity of 0.990. As a result of observation by TEM, carbon black was found encapsulated and uniformly dispersed in the particle.

To 100 parts of the spherical black resin particles were then externally added 1.2 parts of a Type MT-150 titanium oxide and 2.8 parts of a Type SLM50650 hydrophobic silica by means of a Henschel mixer to prepare a toner.

Example 3

To 1,200 parts of a polyester resin having an acid value of 4 mg·KOH/g, a weight-average molecular weight of 12,000, a glass transition point of 61° C. and a melt viscosity of 40,000 poise at 100° C. were added 800 parts of methyl ethyl ketone. The mixture was then thoroughly subjected to dissolution. To the resulting resin solution were then added 121 parts of carbon black. The mixture was then stirred until it was thoroughly dispersed. After the termination of dispersion, the mixture was adjusted with methyl ethyl ketone to a solid content of 50%.

Subsequently, to 200 parts of the mixture were added 50 parts of methyl ethyl ketone and 3.5 parts of a 1 N aqueous ammonia. To the mixture were then added 225 parts of water with stirring at once to cause phase inversion emulsification. As a result, spherical black resin particles were formed. To the particles were then added 150 parts of water as a diluting water and 4 parts of a 1 N aqueous ammonia for increasing dispersion stabilizer.

Subsequently, the particles were processed in the same manner as in Example 1 to obtain spherical black resin particles (pigment content: 9.15%) comprising a polyester resin as a binder resin in the form of powder.

The black resin particles thus obtained had a good particle size distribution such that the volume-average particle diameter thereof is 5.3 $\mu$m, the ratio of 50%-volume particle diameter/50%-number particle diameter thereof is 1.11 and the square root of the ratio of 84%-volume particle diameter/16%-volume particle diameter thereof is 1.19. The black resin particles had an average circularity of 0.988. As a result of observation by TEM, carbon black was found encapsulated and uniformly dispersed in the particle.

To 100 parts of the spherical black resin particles were then externally added 1.1 parts of a Type MT-150 titanium oxide and 1.3 parts of a Type SLM50650 hydrophobic silica by means of a Henschel mixer to prepare a toner.

Comparative Example 1

Particle formation was effected in the same manner as in Example 1 except that the carbon black content was 6%. Thus, a spherical black resin powder (pigment content: 6%) having a good particle size distribution such that the volume-average particle diameter thereof is 5.0 $\mu$m, the ratio of 50%-volume particle diameter/50%-number particle diameter thereof is 1.09 and the square root of the ratio of 84%-volume particle diameter/16%-volume particle diameter thereof is 1.18 was obtained. The particles had an average circularity of 0.989. As a result of observation by TEM, carbon black was found encapsulated and uniformly dispersed in the particle. To 100 parts of the spherical resin particles were then externally added additives in the same manner as in Example 1 to prepare a toner.

Comparative Example 2

The resin solution synthesized in Resin Synthesis Example 1 was desolvated to obtain a styrene acrylate resin having an acid value of 60, a weight-average molecular weight of 52, 000 and a glass transition temperature of 70° C. in the form of solid matter. 1,000 parts of the resin were melt-kneaded with 111 parts of carbon black, ground, and then classified by means of a dry classifier to obtain a black resin powder (pigment content: 10%) having an average circularity of 0.941 and a particle size distribution such that the volume-average particle diameter thereof is 5.3 μm, the ratio of 50%-volume particle diameter/50%-number particle diameter thereof is 1.34 and the square root of the ratio of 84%-volume particle diameter/16%-volume particle diameter thereof is 1.32 was obtained. To the particles were then externally added additives in the same manner as in Example 1 to prepare a toner.

Example 4

To 700 parts of the resin solution obtained in Resin Synthesis Example 1 were added 22.3 parts of a Type Ket Blue 123 phthalocyanine pigment (produced by DAINIPPON INK & CHEMICALS, INC.). The mixture was then stirred to undergo dispersion.

Subsequently, to 100 parts of the mixture were added 10 parts of a 1 N aqueous solution of caustic soda and 13 parts of isopropyl alcohol. To the mixture were then added dropwise 150 parts of water with stirring to cause phase inversion emulsification. As a result, spherical blue resin particles were formed.

Subsequently, the particles were subjected to distillation under reduced pressure to remove the organic solvent therefrom. Thus, an aqueous dispersion was obtained. To the aqueous dispersion was then added a 1 N aqueous solution of hydrochloric acid to adjust the pH value thereof to 2.5. The aqueous slurry was then treated by a centrifugal separator to remove fine powder components therefrom. The aqueous slurry was then passed through a filter (produced by Chisso Filter Co., Ltd.) to remove coarse particles therefrom. The aqueous slurry was filtrated and washed with water to obtain a wet cake. The wet cake thus obtained was heated and dried with stirring under reduced pressure to obtain spherical blue resin particles (pigment content: 6%) comprising a styrene acrylate resin as a binder resin in the form of powder.

The blue resin particles thus obtained had a good particle size distribution such that the volume-average particle diameter thereof is 5.0 μm, the ratio of 50%-volume particle diameter/50%-number particle diameter thereof is 1.10 and the square root of the ratio of 84%-volume particle diameter/16%-volume particle diameter thereof is 1.21. The black resin particles had an average circularity of 0.990. As a result of observation by TEM, phthalocyanine pigment was found encapsulated and uniformly dispersed in the particle.

To 100 parts of the spherical blue resin particles were then externally added 1.1 parts of a Type MT-150 titanium oxide and 1.3 parts of a Type Wacker HDK SLM50650 hydrophobic silica by means of a Henschel mixer to prepare a blue toner.

Example 5

The procedure of Example 4 was followed except that the amount of phthalocyanine pigment and 1 N caustic soda to be used were changed to 50 parts and 11 parts, respectively. As a result, a spherical blue resin powder (pigment content: 12.5%) having a volume-average particle diameter of 4.2 μm and comprising a styrene acrylate resin as a binder resin was obtained.

The blue resin particles thus obtained had a good particle size distribution such that the ratio of 50%-volume particle diameter/50%-number particle diameter thereof is 1.09 and the square root of the ratio of 84%-volume particle diameter/16%-volume particle diameter thereof is 1.18. The particles had an average circularity of 0.991. As a result of observation by TEM, phthalocyanine pigment was found encapsulated and uniformly dispersed in the particle.

To 100 parts of the spherical blue resin particles were then externally added 1.5 parts of a Type MT-150 titanium oxide and 1.8 parts of a Type Wacker HDK SLM50650 hydrophobic silica by means of a Henschel mixer to prepare a blue toner.

Example 6

To 1,200 parts of a. polyester resin having an acid value of 4 mg·KOH/g, a weight-average molecular weight of 12,000, a glass transition point of 61° C. and a melt viscosity of 40,000 poise at 100° C. were added 800 parts of methyl ethyl ketone. The mixture was then thoroughly subjected to dissolution. To the resulting resin solution were then added 76.5 parts of a Type Ket Blue 123 phthalocyanine pigment. The mixture was then stirred until it was thoroughly dispersed. After the termination of dispersion, the mixture was adjusted with methyl ethyl ketone to a solid content of 50%.

Subsequently, to 200 parts of the mixture were added 50 parts of methyl ethyl ketone and 3.5 parts of a 1 N aqueous ammonia. To the mixture were then added 225 parts of water with stirring at once to cause phase inversion emulsification. As a result, spherical blue resin particles were formed. To the particles were then added 150 parts of water as a diluting water and 4 parts of a 1 N aqueous ammonia for increasing dispersion stability.

Subsequently, the particles were subjected to distillation under reduced pressure to remove the organic solvent therefrom. Thus, an aqueous dispersion was obtained. To the aqueous dispersion was then added a 1 N aqueous solution of hydrochloric acid to adjust the pH value thereof to 2.5. The aqueous slurry was then treated by a centrifugal separator to remove fine powder components therefrom. The aqueous slurry was then passed through a filter to remove coarse particles therefrom. The aqueous slurry was filtrated and washed with water to obtain a wet cake. The wet cake thus obtained was heated and dried with stirring under reduced pressure to obtain spherical blue resin particles (pigment content: 6%) comprising a polyester resin as a binder resin in the form of powder.

The blue resin particles thus obtained had a good particle size distribution such that the volume-average particle diameter thereof is 5.0 μm, the ratio of 50%-volume particle diameter/50%-number particle diameter thereof is 1.11 and the square root of the ratio of 84%-volume particle diameter/16%-volume particle diameter thereof is 1.20. The blue resin particles had an average circularity of 0.990. As a result of observation by TEM, the phthalocyanine pigment was found encapsulated and uniformly dispersed in the particle.

To 100 parts of the spherical blue resin particles were then externally added 1.1 parts of a Type MT-150 titanium oxide and 1.3 parts of a Type Wacker HDK SLM50650 hydrophobic silica by means of a Henschel mixer to prepare a toner.

Example 7

The procedure of Example 6 was followed except that the pigment was changed to a Type Ket Yellow 403 disazo pigment (produced by DAINIPPON INK & CHEMICALS, INC.). As a result, a spherical yellow resin powder (pigment content: 6%) was obtained.

The yellow resin particles thus obtained had a good particle size distribution such that the volume-average particle diameter thereof is 4.8 μm, the ratio of 50%-volume particle diameter/50%-number particle diameter thereof is 1.12 and the square root of the ratio of 84%-volume particle diameter/16%-volume particle diameter thereof is 1.21. The blue resin particles had an average circularity of 0.988. The particles were then observed at a section thereof by TEM. As a result, the pigment was found encapsulated and uniformly dispersed in the particle. To the spherical yellow resin particles were then externally added additives in the same manner as in Example 1 to prepare a yellow toner.

Example 8

The procedure of Example 6 was followed except that the pigment was changed to 90.3 parts of a Type Toner Magenta E-02 quinacridone pigment (produced by Hoechst Industry Corp.). As a result, a spherical red resin powder (pigment content: 7%) was obtained.

The red resin particles thus obtained had a good particle size distribution such that the volume-average particle diameter thereof is 5.1 μm, the ratio of 50%-volume particle diameter/50%-number particle diameter thereof is 1.14 and the square root of the ratio of 84%-volume particle diameter/16%-volume particle diameter thereof is 1.23. The red resin particles had an average circularity of 0.989. The particles were then observed at a section thereof by TEM. As a result, the pigment was found encapsulated and uniformly dispersed in the particle. To the spherical red resin particles were then externally added additives in the same manner as in Example 1 to prepare a red toner.

Comparative Example 3

The procedure of Example 6 was followed except that the added amount of the phthalocyanine pigment was changed to 38.3 parts. As a result, a spherical blue resin powder (pigment content: 3%) having an average circularity of 0.990 and a good particle size distribution such that the volume-average particle diameter thereof is 5.0 μm, the ratio of 50%-volume particle diameter/50%-number particle diameter thereof is 1.09 and the square root of the ratio of 84%-volume particle diameter/16%-volume particle diameter thereof is 1.18 and comprising a colorant encapsulated therein was obtained. To the spherical blue resin particles were then externally added additives in the same manner as in Example 6 to prepare a blue toner.

Comparative Example 4

940 parts of the same polyester resin as used in Example 6 were melt-kneaded with 60 parts of the same phthalocyanine pigment "Ket Blue 123" as used in Example 6, crushed, and then classified by means of a dry classifier to obtain an amorphous blue resin powder (pigment content: 6%) having an average circularity of 0.943 and a particle size distribution such that the volume-average particle diameter thereof is 5.3 μm, the ratio of 50%-volume particle diameter/50%-number particle diameter thereof is 1.34 and the square root of the ratio of 84%-volume particle diameter/16%-volume particle diameter thereof is 1.32 was obtained. To the particles were then externally added additives in the same manner as in Example 6 to prepare a blue toner.

The 12 kinds of powder toners thus prepared were then evaluated as one-component developer in the following manner.

The black toners of Examples 1, 2 and 3 and Comparative Examples 1 and 2 were each loaded in the toner cartridge of a commercial one-component printer (Type OKI Microline 400), and then measured for triboelectricity on the development sleeve by means of a Type E-SPART analyzer (produced by HOSOKAWA MICRON CORP.). Further, images were printed with these toners using this printer. The images thus printed were then evaluated for quality (For the measurement of image density, a Macbeth densitometer was used). (See Table 1)

These toners were also evaluated as two-component developer in the following manner. In some detail, the toners thus prepared were each mixed with a silicone resin-coated ferrite carrier (produced by Powdertech Co., Ltd.; average particle diameter: 50 μm) to prepare a two-component developer which was then measured for triboelectricity by means of a Type E-SPART analyzer. Further, images were printed with these toners using a commercially available copying machine (Ricoh Imagio MF-530). The images thus printed were then evaluated for quality. (See Table 2)

TABLE 1

| | Triboelectricity on one-component development | | | Image by one-component development | |
|---|---|---|---|---|---|
| Example No. | Q/M (μC/g) | Q/D (fC/10 μmm) | Reverse charging percent (Mass %) | Fog | Image density |
| Example 1 | −20.5 | −1.8 | 8.6 | None | 1.60 |
| Example 2 | −18.9 | −1.5 | 10.4 | None | 1.58 |
| Example 3 | −21.0 | −2.9 | 6.8 | None | 1.61 |
| Comparative Example 1 | −20.8 | −1.9 | 8.0 | None | 1.22 |
| Comparative Example 2 | −4.8 | −0.7 | 18.5 | Observed | 1.15 |

TABLE 2

| | Triboelectricity on two-component development | | | Image by two-component development | |
|---|---|---|---|---|---|
| Example No. | Q/M (μC/g) | Q/D (fC/10 μmm) | Reverse charging percent (Mass %) | Fog | Image density |
| Example 1 | −38.6 | −3.8 | 2.8 | None | 1.62 |
| Example 2 | −46.5 | −3.6 | 3.9 | None | 1.59 |
| Example 3 | −42.1 | −8.8 | 2.1 | None | 1.60 |
| Comparative Example 1 | −39.4 | −4.0 | 2.6 | None | 1.21 |
| Comparative Example 2 | −25.8 | −2.3 | 14.2 | Observed | 1.32 |

In accordance with the toner formulation of Examples 1, 2 and 3, a good triboelectricity and image quality can be obtained in both one-component development and two-component development regardless of particle diameter and kind of resin. On the contrary, as can be seen in Comparative Example 1, toner formulations having a reduced colorant content exhibit a good triboelectricity but give so low an image density on the printing paper that they leave something to be desired in practical properties. Further, as can be seen in Comparative Example 2, small particle diameter toners prepared by pulverization process have a non-spherical form and a broad particle size distribution and a pigment partially exposed at the surface of particles and exhibit a poor triboelectricity and image quality and thus can be difficulty put into practical use.

The images formed with the toners or developers of Examples 1, 2 and 3 all exhibited a good resolution and tone reproduction.

The results of evaluation of the amount of toner consumed per page will be described hereinafter. The amount of toners of Examples 1, 2 and 3 consumed when a test pattern was printed on 100 sheets of printing paper using the foregoing commercially available printer or copying machine was from 0.8 to 1.2 g. On the other hand, the amount of the exclusive toner for the printer or copying machine consumed when the same printing was effected was from 2.0 to 2.3 g. The use of a spherically particulate toner having a small particle diameter and a high pigment concentration according to the present invention makes it possible to drastically reduce the amount of toner consumed per page.

The evaluation of 7 color toners of Examples 4 to 8 and Comparative Examples 3 and 4 as one-component developer and two-component developer was effected in the same manner as for the foregoing black toner. The results are set forth in Tables 3 and 4.

TABLE 3

| | Triboelectricity on two-component development | | | Image by two-component development | |
|---|---|---|---|---|---|
| Example No. | Q/M (μC/g) | Q/D (fC/10 μmm) | Reverse charging percent (Mass %) | Fog | Image density |
| Example 4 | −18.6 | −1.7 | 8.2 | None | 1.46 |
| Example 5 | −19.0 | −1.8 | 7.9 | None | 1.56 |
| Example 6 | −19.5 | −1.8 | 7.6 | None | 1.47 |
| Example 7 | −18.9 | −1.6 | 9.4 | None | 1.43 |
| Example 8 | −20.2 | −2.1 | 7.0 | None | 1.50 |
| Comparative Example 3 | −20.5 | −1.9 | 7.3 | None | 1.12 |
| Comparative Example 4 | −5.0 | −0.8 | 17.5 | Observed | 1.18 |

TABLE 4

| | Triboelectricity on two-component development | | | Image by two-component development | |
|---|---|---|---|---|---|
| Example No. | Q/M ($\mu$C/g) | Q/D (fC/10 $\mu$mm) | Reverse charging percent (Mass %) | Fog | Image density |
| Example 4 | −37.8 | −3.9 | 3.3 | None | 1.48 |
| Example 5 | −38.5 | −4.0 | 3.1 | None | 1.56 |
| Example 6 | −42.3 | −4.6 | 2.8 | None | 1.50 |
| Example 7 | −44.5 | −4.2 | 3.0 | None | 1.47 |
| Example 8 | −43.1 | −4.9 | 2.1 | None | 1.52 |
| Comparative Example 3 | −41.8 | −4.0 | 2.6 | None | 1.16 |
| Comparative Example 4 | −24.8 | −2.1 | 14.7 | Observed | 1.26 |

The toner formulations of Examples 6 to 8 exhibit almost the same good triboelecltricity and give a good image in both one-component development and two-component development regardless of kind of pigment. The toner formulations of Examples 4 and 5 exhibit almost the same good triboelectricity and give a good image regardless of kind of resin and pigment content.

On the contrary, as can be seen in Comparative Example 3, toner formulations having a reduced colorant content exhibit a good triboelectricity but give so low an image density on the printing paper that they leave something to be desired in practical properties. Further, as can be seen in Comparative Example 4, small particle diameter toners prepared by pulverization process have a non-spherical form and a broad particle size distribution and a pigment partially exposed at the surface of particles and exhibit a poor triboelectricity and image quality and thus can be difficultly put into practical use.

The images formed with the toners or developers of Examples 4 to 8 all exhibited a good resolution and tone reproduction.

These toners were also evaluated for amount consumed per page in the same manner as for the foregoing black toners. The amount of the toners and developers of Examples 4 to 8 consumed per page when printing was made on 100 sheets of printing paper was from 1.0 to 1.4 g. Thus, the amount of toner consumed per page was drastically reduced.

Examples of emulsion dispersion association process suitable for the preparation of toner of the present invention, particularly polyester toner, will be described hereinafter.

Resin Synthesis Example 2 (Example of synthesis of polyester resin)

Into a flask equ.ipped with an agitator, a thermometer, an $N_2$ gas intake tube and a fractionating column were charged 1,955 parts (5.5 mols) of a product of addition of 2.2 mols of propylene oxide to bisphenol A and 1,789 parts (5.5 mols) of a product of addition of 2.2 mols of ethylene oxide to bisphenol A. Into the flask were then charged 830 parts (5 mols) of terephthalic acid, 830 parts (5 mols) of isophthalic acid and 4 parts of dibutyl tin oxide. In a flow of $N_2$ gas, the reaction mixture was heated to a temperature of 230° C. where it was then allowed to undergo dehydrocondensation reaction with stirring. The reaction was effected under conditions that the monomers as starting materials were not distilled off and, if they were distilled off, the distillation loss was made up for to form the resin composition as originally charged. The reaction was allowed to proceed until the acid value of the resin composition reached 4 mg·KOH/g. The supply of $N_2$ gas was then suspended. The reaction solution was allowed to cool to room temperature with stirring. The resulting resin exhibited a weight-average molecular weight of 12,000 as determined by GPC. The resin also exhibited a glass transition temperature of 61° C. as determined by means of a Type DSC-50 differential scanning calorimeter produced by Shimadzu Corp. The resin thus prepared was further measured for melt viscosity by means of a Type CFT-500 flow tester produced by Shimadzu Corp. The results were $4\times10^4$ poise at 100° C.

Example 9

To 1,200 parts of the polyester resin obtained in Resin Synthesis Example 2 were added 800 parts of methyl ethyl ketone to make a resin solution. To the resin solution thus prepared were then added 64 parts of Ket Blue 123. The mixture was then treated by an Eiger motor mill to cause the pigment to be dispersed therein. To the dispersion was then added methyl ethyl ketone so that the solid content reached 50% to obtain a mill base.

Into a 1 L flask were then charged 200 parts of the mill base thus obtained, 50 parts of methyl ethyl ketone and 3.5 parts of a 1 N aqueous ammonia. The reaction mixture was then heated to a temperature of 30° C. with stirring at 3,000 rpm by means of a homomixer (diameter of agitating portion: 30 mm). When the temperature was kept constant, the rotary speed of the homomixer was raised to 13,000 rpm (circumferential speed: 19.4 m/s). To the reaction mixture were then added 225 parts of deionized water the temperature of which had been adjusted to 30° C. to cause phase inversion emulsification. Thus, finely divided particles having a particle diameter of 3.7 $\mu$m were formed. The dispersion thus prepared was further stirred under the same conditions as above. The rate of stirring was then reduced to 3,000 rpm (circumferential speed: 4.5 m/s). To the dispersion were then added 150 parts of deionized water and 4 parts of a 1 N aqueous ammonia.

Subsequently, the mixture was distilled under reduced pressure to remove the organic solvent therefrom. The residue was then filtered and washed with water. To the material was then added a 1 N aqueous solution of hydrochloric acid so that the pH value thereof reached about 2.5. The material was then filtered and washed with water to obtain a wet cake. The wet cake thus obtained was then dried to obtain the desired blue resin particles having a colorant encapsulated therein.

The colored resin particles had a volume-average particle diameter of 5.7 μm and an average circularity of 0.989. The particle was observed by TEM. As a result, the pigment was found uniformly dispersed in the particle. No voids were observed.

To the colored resin particles was then externally added 0.7% by weight of a Type AEROSIL R976 hydrophobic silica (produced by Nippon Aerosil Co., Ltd.) bymeans of a Henschel mixer to prepare a toner.

Example 10

To 1,200 parts of the polyester resin obtained in Resin Synthesis Example 2 were added 800 parts of methyl ethyl ketone to make a resin solution. To the resin solution thus prepared were then added 64 parts of a Type Ket Yellow 403 disazo pigment (produced by DAINIPPON INK & CHEMICALS, INC.; barium sulfate-free product). The mixture was then treated by an Eiger motor mill to cause the pigment to be dispersed therein. To the dispersion was then added methyl ethyl ketone so that the solid content reached 50% to obtain a mill base.

Into a 1 L flask were then charged 200 parts of the mill base thus obtained, 85.7 parts of methyl ethyl ketone, 5.7 parts of a 1 N aqueous ammonia and 0.13 part of calcium chloride dihydrate. The reaction mixture was then heated to a temperature of 30° C. with stirring at 3,000 rpm by means of a homomixer. When the temperature was kept constant, the rotary speed of the homomixer was raised to 10,000 rpm (circumferential speed: 14.9 m/s). To the reaction mixture were then added 257 parts of deionized water the temperature of which had been adjusted to 30° C. to cause phase inversion emulsification. Thus, fine particles having a particle diameter of 4.4 μm were formed. The dispersion thus prepared was further stirred under the same conditions as above for 12 minutes. The rate of stirring was then reduced to 3,000 rpm (circumferential speed: 4.5 m/s). To the dispersion were then added 200 parts of deionized water and 3.5 parts of a 1 N aqueous ammonia.

Subsequently, the mixture was distilled under reduced pressure to remove the organic solvent therefrom. The residue was then filtered and washed with water. To the material was then added a 1 N aqueous solution of hydrochloric acid so that the pH value thereof reached about 2.5. The material was then filtered and washed with water to obtain a wet cake. The wet cake thus obtained was then dried to obtain the desired yellow resin particles having a colorant encapsulated therein.

The yellow resin particles had a volume-average particle diameter of 5.9 μm and an average circularity of 0.988. The particle was observed at a section thereof by TEM. As a result, the pigment was found uniformly dispersed in the particle. No voids were observed.

To the colored resin particles was then externally added 0.7% by weight of a Type AEROSIL R976 hydrophobic silica by means of a Henschel mixer to prepare a toner.

Example 11

To 1,200 parts of the polyester resin obtained in Resin Synthesis Example 2 were added 800 parts of methyl ethyl ketone to make a resin solution. To the resin solution thus prepared were then added 64 parts of a Type Toner Magenta E-02 quinacridone pigment (produced by Hoechst Industry Corp.). The mixture was then treated by an Eiger motor mill to cause the pigment to be dispersed therein. To the dispersion was then added methyl ethyl ketone so that the solid contentreached 50% to obtain a mill base.

Into a 1 L flask were then charged 200 parts of the mill base thus obtained, 85.7 parts of methyl ethyl ketone, 6.6 parts of a 1 N aqueous ammonia and 0.13 part of calcium chloride dihydrate. The reaction mixture was then heated to a temperature of 15° C. with stirring at 3,000 rpm by means of a homomixer. When the temperature was kept constant, the rotary speed of the homomixer was raised to 9,000 rpm (circumferential speed: 13.4 m/s). To the reaction mixture were then added 230 parts of deionized water the temperature of which had been adjusted to 15° C. to cause phase inversion emulsification. Thus, fine particles having a particle diameter of 5.1 μm were formed. The dispersion thus prepared was further stirred under the same conditions as above for 11 minutes. The rate of stirring was then reduced to 3,000 rpm (circumferential speed: 4.5 m/s). To the dispersion were then added 200 parts of deionized water and 2.8 parts of a 1 N aqueous ammonia.

Subsequently, the mixture was distilled under reduced pressure to remove the organic solvent therefrom. The residue was then filtered and washed with water. To the material was then added a 1 N aqueous solution of hydrochloric acid so that the pH value thereof reached about 2.5. The material was then filtered and washed with water to obtain a wet cake. The wet cake thus obtained was then dried to obtain the desired red resin particles having a colorant encapsulated therein.

The red resin particles had a volume-average particle diameter of 5.7 μm and an average circularity of 0.989. The particle was observed at a section thereof by TEM. As a result, the pigment was found uniformly dispersed in the particle. No voids were observed.

To the red resin particles was then externally added 0.7% by weight of a Type AEROSIL R976 hydrophobic silica by means of a Henschel mixer to prepare a toner.

(Test for evaluation of toners of Examples 9 to 11)

The three toners obtained in Examples 9 to 11 were each subjected to imaging test using a commercially available non-magnetic one-component development printer (Epson LP-1700). As a result, all these toners gave images excellent in density, resolution and tone reproduction.

4 parts by weight of each of these toners were mixed with 100 parts by weight of a silicone-coated ferrite having a particle diameter of 80 μm. The mixtures were each then measured for blow-off charge. As a result, these toners exhibited almost the same value as follows.

| | Blow-off charge |
|---|---|
| Toner of Example 9 | −48 μC/g |
| Toner of Example 10 | −49 μC/g |
| Toner of Example 11 | −48 μC/g |

These two-component developers were each subjected to imaging test using a commercially available copying machine DC-111 (produced by Mita Industrial Co., Ltd.).

As a result, all these toners gave images excellent in density, resolution and tone reproduction.

What is claimed is:

1. A spherically particulate toner comprising a colorant and a binder resin, wherein said toner has a volume-average particle diameter of from 1 to 6 μm, the content of the colorant is not less than 9.1% by weight based on the total weight of the binder resin and the colorant, and said toner has an average circularity (average of circularity defined by (perimeter of circle having the same area as the projected area of particle)/(perimeter of the projected image of particle)) of not less than 0.98.

2. The spherically particulate toner according to claim 1, comprising inorganic oxide fine particles externally added to the surface thereof in an amount represented by the following general formula:

$$3.5714X^{-0.9942} \leqq Y \leqq 31.399X^{-0.9477}$$

wherein X represents a volume-average particle diameter (μm) of toner particles; and Y represents an added amount (wt-%) of the inorganic oxide fine particles based on the weight of toner particles.

3. The spherically particulate toner according to any one of claims 1 or 2, wherein said particulate toner is obtained by mixing an organic solvent solution comprising a colorant and a water-insoluble binder resin as essential components and an aqueous medium, emulsifying the mixture to form spherical colored particles, and then withdrawing the said particles dispersed in the liquid medium in the form of dried powder.

4. The spherically particulate toner according to any one of claims 1 or 2, wherein said particulate toner is obtained by a process which comprises allowing a polymerizable monomer having a colorant dispersed therein to undergo polymerization in a liquid medium to form spherical colored particles, and then withdrawing the said particles dispersed in the liquid medium in the form of dried powder.

5. The spherically particulate toner according to claim 1, characterized by having a particle size distribution such that the square root of the ratio of 84%-volume particle diameter/16%-volume particle diameter is not more than 1.25 and comprising the colorant encapsulated in the binder resin.

6. The spherically particulate toner according to claim 5, having a particle size distribution such that the ratio of 50%-volume particle diameter/50%-number particle diameter is not more than 1.25.

7. The spherically particulate toner according to claim 1, characterized in that said particulate toner is obtained by emulsifying an organic solvent solution comprising a colorant and a water-insoluble acid group-containing polyester resin as essential components and an aqueous medium under a high shearing action in the presence of a basic neutralizer to form colorant-containing fine particles, further stirring and mixing the fine particles so that they associate to form spherical colored particles having a greater particle diameter than said fine particles and comprising a colorant encapsulated therein, and then withdrawing the said associated particles dispersed in the liquid medium in the form of dried powder.

8. A spherically particulate color toner comprising a colorant and a binder resin, wherein said toner has a volume-average particle diameter of from 1 to 6 μm and an average circularity (average of circularity defined by (perimeter of circle having the same area as the projected area of particle)/(perimeter of the projected image of particle)) of not less than 0.98 and said colorant is an organic chromatic pigment and the content thereof is not less than 5% by weight based on the total weight of the binder resin and the colorant.

9. The spherically particulate color toner according to claim 8, characterized by having a particle size distribution such that the square root of the ratio of 84%-volume particle diameter/16%-volume particle diameter is not more than 1.25 and comprising the colorant encapsulated in the binder resin.

10. The spherically particulate color toner according to claim 9, having a particle size distribution such that the ratio of 50%-volume particle diameter/50%-number particle diameter is not more than 1.25.

11. The spherically particulate color toner according to claims 8 or 10, comprising inorganic oxide fine particles externally added to the surface thereof in an amount represented by the following general formula:

$$3.5714X^{-0.994} \leqq Y \leqq 31.399X^{-0.9477}$$

wherein X represents a volume-average particle diameter (μm) of toner particles; and Y represents an added amount (wt-%) of inorganic oxide fine particles based on the weight of toner particles.

12. The spherically particulate color toner according to claims 8 or 10, wherein said colorant is an organic chromatic pigment and said binder resin is an acid group-containing polyester resin.

13. The spherically particulate color toner according to claims 8 to 10, wherein said particulate toner is obtained by mixing an organic solvent solution comprising a colorant and a water-insoluble binder resin as essential components and an aqueous medium, emulsifying the mixture to form spherical colored particles, and then withdrawing the said particles dispersed in the liquid medium in the form of dried powder.

14. The spherically particulate color toner according to claims 8 to 10, wherein said particulate toner is obtained by a process which comprises allowing a polymerizable monomer having a colorant dispersed therein to undergo polymerization in a liquid medium to form spherical colored particles, and then withdrawing the said particles dispersed in the liquid medium in the form of dried powder.

15. The spherically particulate color toner according to claim 8, characterized in that said particulate toner is obtained by emulsifying an organic solvent solution comprising a colorant and a water-insoluble acid group-containing polyester resin as essential components and an aqueous medium under a high sheering action in the presence of a basic neutralizer to form colorant-containing fine particles, further stirring and mixing the fine particles so that they associate to form spherical colored particles having a greater particle diameter than said fine particles and comprising a colorant encapsulated therein, and then withdrawing the said associated particles dispersed in the liquid medium in the form of dried powder.

16. The spherically particulate toner according to claim 1 or 8, wherein said particulate toner is obtained by emulsifying an organic solvent solution comprising a colorant and a water-insoluble acid group-containing polyester resin as essential components and an aqueous medium under a high shearing action in the presence of a basic neutralizer to form colorant-containing fine particles, further stirring the fine particles so that they associate to form spherical colored particles having a greater particle diameter than said fine particles comprising a colorant encapsulated therein, and then withdrawing the said associated particles dispersed in the liquid medium in the form of dried powder.

17. A spherically particulate toner characterized by comprising a colorant and a binder resin, wherein said toner has a volume-average particle diameter of from 1 to 6 μm, the content of the colorant is not less than 9.1% by weight based on the total weight of the binder resin and the colorant, said toner has an average circularity (average of circularity defined by (perimeter of circle having the same area as the projected area of particle)/(perimeter of the projected image of particle)) of not less than 0.98, and said binder resin comprises a polyester resin.

18. The spherically particulate toner according to claim 17, characterized by having a particle size distribution such that the square root of the ratio of 84%-volume particle diameter/16%-volume particle diameter is not more than 1.25 and comprising the colorant encapsulated in the binder resin.

19. The spherically particulate toner according to claim 18, characterized by having a particle size distribution such that the ratio of 50%-volume particle diameter/50%-number of particle diameter is not more than 1.25.

20. The spherically particulate toner according to claim 17 or 19, characterized in that said particulate toner is obtained by mixing a mixture comprising a colorant and a water-insoluble binder resin as essential components with an aqueous medium, emulsifying the mixture to form spherical colored particles, and then withdrawing the said particles dispersed in the liquid medium in the form of dried powder.

21. The spherically particulate toner according to claim 1 or 17, characterized in that said particulate toner is obtained by mixing a mixture comprising a colorant and a water-insoluble binder resin having an acid group as essential components with an aqueous medium in the presence of a basic neutralizer, emulsifying the mixture to form spherical colored particles, and then withdrawing the said particles dispersed in the liquid medium in the form of dried powder.

22. A spherically particulate color toner characterized by comprising a colorant and a binder resin, wherein said toner has a volume-average particle diameter of from 1 to 6 $\mu$m, the colorant is an organic chromatic pigment and the content of the same is not less than 5% by weight based on the total weight of the binder resin and the colorant, and said toner has an average circularity (average of circularity defined by (perimeter of circle having the same area as the projected area of particle)/(perimeter of the projected image of particle)) of not less than 0.98, and said binder resin comprises a polyester resin.

23. The spherically particulate color toner according to claim 22 characterized by having a particle size distribution such that the square root of the ration of 84%-volume particle diameter/16%-volume particle diameter is not more than 1.25 and comprising the colorant encapsulated in the binder resin.

24. The spherically particulate color toner according to claim 23, characterized by having a particle size distribution such that the ratio of 50%-volume particle diameter/50%-number particle diameter is not more than 1.25.

25. The spherically particulate color toner according to claim 22 or 24, characterized in that said particulate toner is obtained by mixing a mixture comprising a colorant and a water-insoluble binder resin as essential components with an aqueous medium, emulsifying the mixture to form spherical colored particles, and then withdrawing the said particles dispersed in the liquid medium in the form of dried powder.

26. The spherically particulate color toner according to claims 8 or 22, characterized in that said particulate toner is obtained by mixing a mixture comprising a colorant and a water-insoluble binder resin having an acid group as essential components with an aqueous medium in the presence of a basic neutralizer, emulsifying the mixture to form spherical colored particles, and then withdrawing the said particles dispersed in the liquid medium in the form of dried powder.

27. A non-magnetic one-component developer comprising the spherically particulate toner according to claim 1, 6, 8, 10, 17, 19, 22 or 24.

* * * * *